US010551029B2

(12) United States Patent
Mercado Peña

(10) Patent No.: US 10,551,029 B2
(45) Date of Patent: Feb. 4, 2020

(54) LIGHTING DEVICE WITH HOMOGENEOUS LIGHT DISTRIBUTION

(71) Applicant: HELLA GmbH & Co. KGaA, Lippstadt (DE)

(72) Inventor: José Miguel Mercado Peña, Canton, MI (US)

(73) Assignee: HELLA GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 16/267,992

(22) Filed: Feb. 5, 2019

(65) Prior Publication Data

US 2019/0242550 A1 Aug. 8, 2019

Related U.S. Application Data

(60) Provisional application No. 62/626,775, filed on Feb. 6, 2018.

(51) Int. Cl.

| | |
|---|---|
| ***F21S 41/143*** | (2018.01) |
| ***F21V 5/04*** | (2006.01) |
| ***F21S 41/265*** | (2018.01) |
| ***F21S 43/20*** | (2018.01) |
| ***F21S 41/151*** | (2018.01) |
| ***F21S 43/14*** | (2018.01) |
| *F21Y 115/10* | (2016.01) |

(52) U.S. Cl.

CPC ..... *F21V 5/045* (2013.01); *F21S 41/143* (2018.01); *F21S 41/151* (2018.01); *F21S 41/265* (2018.01); *F21S 43/14* (2018.01); *F21S 43/26* (2018.01); *F21Y 2115/10* (2016.08)

(58) Field of Classification Search

CPC ..... F21V 5/045; F21S 43/26; F21S 41/143; F21S 41/151; F21S 41/265

See application file for complete search history.

(56) References Cited

U.S. PATENT DOCUMENTS 2,356,654 A * 8/1944 Cullman ..... F21V 5/04 362/223
5,526,190 A * 6/1996 Hubble, III ..... F21V 7/0091 347/102

(Continued)

FOREIGN PATENT DOCUMENTS

DE 102017110886 * 11/2018 ..... F21S 41/00
FR 3045781 A1 * 6/2017 ..... F21S 43/245

*Primary Examiner* — Julie A Bannan

(74) *Attorney, Agent, or Firm* — Warner Norcross + Judd LLP

(57) ABSTRACT

A lighting device for a motor vehicle is provided, for example a head lamp or a tail lamp. The lighting device includes an array of light sources, a lens assembly having a collimator lens, an inner lens, and an outer lens, and a housing to maintain the lens assembly in fixed relation relative to the array of light sources. The collimator lens includes a central geometry to manage high intensity light from directly above the LEDs and a lateral geometry to manage low intensity light that is offset from the LEDs, such that the light output from the LEDs exits the lens assembly with a homogeneous light distribution. The lighting device is suitable for vehicle applications, including internal lighting applications and external vehicle lighting applications. The lighting device can be manufactured by extrusion, making it well suited for low cost applications, such as interior ambient lighting.

16 Claims, 8 Drawing Sheets

(56) References Cited

U.S. PATENT DOCUMENTS

| | | | | |
|---|---|---|---|---|
| 5,657,169 | A * | 8/1997 | Caroli | B29C 33/3892 359/737 |
| 6,536,923 | B1 * | 3/2003 | Merz | F21V 7/0091 362/327 |
| 6,724,543 | B1 * | 4/2004 | Chinniah | F21V 5/008 359/718 |
| 6,902,291 | B2 * | 6/2005 | Rizkin | B64F 1/20 362/153.1 |
| 7,213,945 | B2 * | 5/2007 | Yoneda | H01L 33/58 257/E33.071 |
| 7,580,192 | B1 * | 8/2009 | Chu | F21V 5/04 359/641 |
| 7,641,365 | B2 * | 1/2010 | Katzir | H04N 1/02855 359/708 |
| 8,292,455 | B2 * | 10/2012 | Koizumi | F21S 43/30 362/217.02 |
| 9,849,984 | B2 * | 12/2017 | Ohta | B64D 11/00 |
| 2010/0135036 | A1 * | 6/2010 | Matsuba | F21S 41/322 362/516 |
| 2011/0249462 | A1 * | 10/2011 | Koizumi | B60Q 1/302 362/519 |
| 2011/0267823 | A1 * | 11/2011 | Angelini | F21L 4/027 362/277 |
| 2011/0280031 | A1 | 11/2011 | Luger | |
| 2012/0033441 | A1 * | 2/2012 | Sousek | F21S 43/14 362/555 |
| 2016/0377272 | A1 * | 12/2016 | Chen | F21V 23/0457 362/235 |
| 2017/0328542 | A1 * | 11/2017 | He | F21V 14/02 |
| 2018/0335191 | A1 * | 11/2018 | Stefanov | F21S 41/16 |
| 2019/0003676 | A1 * | 1/2019 | Franc | F21S 43/245 |

* cited by examiner

LIGHTING DEVICE WITH HOMOGENEOUS LIGHT DISTRIBUTION

CROSS-REFERENCE TO RELATED APPLICATION

This application claims the benefit of U.S. Provisional Application 62/626,775, filed Feb. 6, 2018, the disclosure of which is hereby incorporated by reference in its entirety.

FIELD OF THE INVENTION

The present invention generally pertains to lighting devices for use on a motor vehicle, and more specifically, interior and exterior lighting devices having light emitting diodes.

BACKGROUND OF THE INVENTION

Light emitting diodes (LEDs) are known to provide improved optical efficiency over conventional forms of lighting, and are widely used in automotive applications. Despite their advantages, however, LEDs provide low uniformity in the output of light. In particular, individual LEDs provide a Lambertian distribution of light, such that the intensity of light is greatest immediately above the LED but diminishes when viewed from an angle.

Many automotive lighting manufacturers attempt to achieve a homogeneous lit appearance using Fresnel lenses alone or in combination with a scattering element, such as a scattering film or a textured lens. However, conventional solutions provide a segmented lit appearance due to a variety of factors. For example, a segmented lit appearance is often attributed to the difference in luminance between the bull's eye, the dioptric, and the catadioptric regions of a Fresnel lens, which drives the need of a very deep device to allow the maximum light to mix, and/or the use of expensive scattering films.

It would therefore be beneficial to provide an improved lighting device which generates a homogeneous light distribution across an illuminated area. In particular, it would be beneficial to provide improved control of light uniformity without unduly adding expense or complexity to a lighting device having one or more LED light sources.

SUMMARY OF THE INVENTION

A vehicle lighting device for providing a homogeneous lit appearance is provided. In one embodiment, the vehicle lighting device includes an array of LED light sources, a lens assembly having a collimator lens, an inner lens, and an outer lens, and a housing to maintain the lens assembly in fixed relation relative to the array of LED light sources. The collimator lens includes two sections, a light incoupling section and a light outcoupling section, to redistribute light with generally uniform intensity. In addition, the collimator lens includes a central geometry to manage high intensity light from directly above the LEDs and a lateral geometry to manage low intensity light that is offset from the LEDs, such that the light output from the LEDs exits the lens assembly with a homogeneous lit appearance.

In another embodiment of the vehicle lighting device, the collimator lens is formed of a light transmissive material and includes an upper lens section, a lower lens section, and a central lens section. The upper lens section is integrally formed with the central lens section and emits incident light from the array of LED light sources by internally reflecting the incident light at an upper reflection surface. The lower lens section is integrally formed with the central lens section and emits incident light from the array of LED light sources by internally reflecting the incident light at a lower reflection surface. The central lens section includes a planar light receiving surface and a light emitting surface that defines a Fresnel lens. The collimator lens in this embodiment is symmetrical about a horizontal plane of symmetry that is perpendicular to the planar light receiving surface of the central lens section. Light emitted by the array of light sources emerges through the collimator lens as collimated light and is projected through the outer lens.

In these and other embodiments of the vehicle lighting device, the array of LED light sources are powered by an on-board power supply and include monochromatic or RGB LEDs. The inner lens directs light toward the outer lens, which is optionally a color filter. The inner lens and the outer lens optionally include a textured surface comprising reflex pins. The lighting device can be manufactured as a head lamp or a rear combination lamp, among other applications, to generating a lighting function forward or rearward of the vehicle. The lighting device is also well suited for other applications, such as interior lighting for heavy duty trucks, without requiring expensive scattering films and is achieved with a housing of reasonable depth.

These and other advantages and features of the invention will be more fully understood and appreciated by reference to the drawings and the description of the current embodiments.

DESCRIPTION OF THE CURRENT EMBODIMENTS

Figure 1:
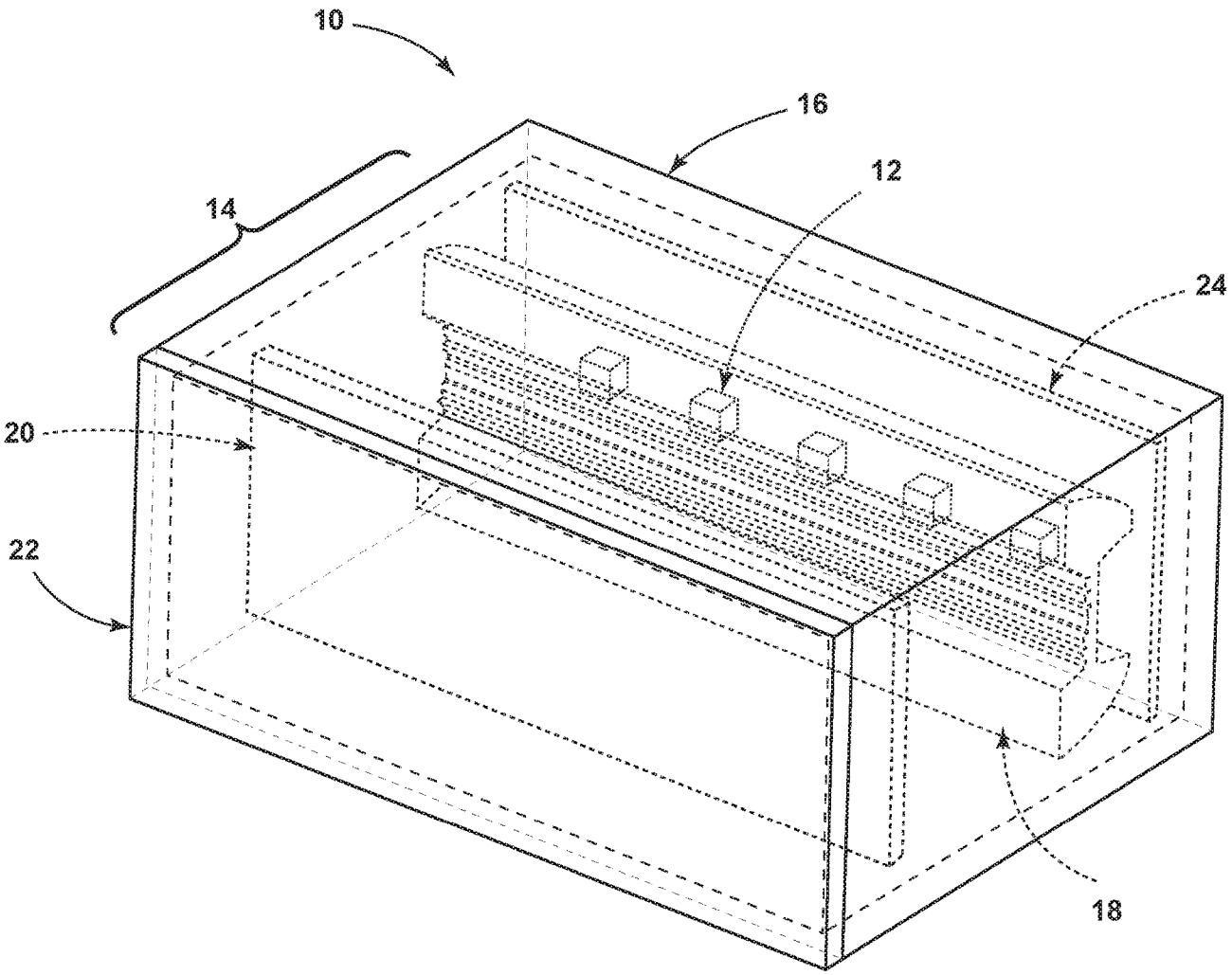
FIG. 1 includes a perspective view of a lighting device in accordance with one embodiment of the invention.

A lighting device in accordance with the current embodiments is depicted in FIGS. 1-8 and generally designated 10. The lighting device 10 includes an array of light sources 12, a lens assembly 14, and a housing 16. The lens assembly 14 includes a collimator lens 18, an inner lens 20, and an outer lens 22 that cooperate to redistribute light with generally uniform intensity. In external applications, for example as a vehicle head lamp or a vehicle tail lamp, the lens assembly 14 provides a homogeneous lighting function forward or rearward of the vehicle. Each such feature of the lighting device 10 is discussed below.

The array of light sources 12 includes a plurality of LEDs disposed on a substrate, for example a printed circuit board (PCB) 24. In the illustrated embodiment, the plurality of LEDs 12 include five LEDs that are spaced apart from each other along a longitudinal axis of the PCB 24. The plurality of LEDs 12 are arranged in a line along the longitudinal axis of the PCB 24 and are set back from the collimator lens 18 such that no portion of the collimator lens 18 overlies the plurality of LEDs 12. The plurality of LEDs can include monochromatic LEDs in some embodiments, while in other embodiments the plurality of LEDs can be RGB LEDs. The plurality of LEDs receive power from a DC power supply, optionally an onboard DC power supply, while in other embodiments the DC power supply is external to the lighting device 10.

Figure 2:
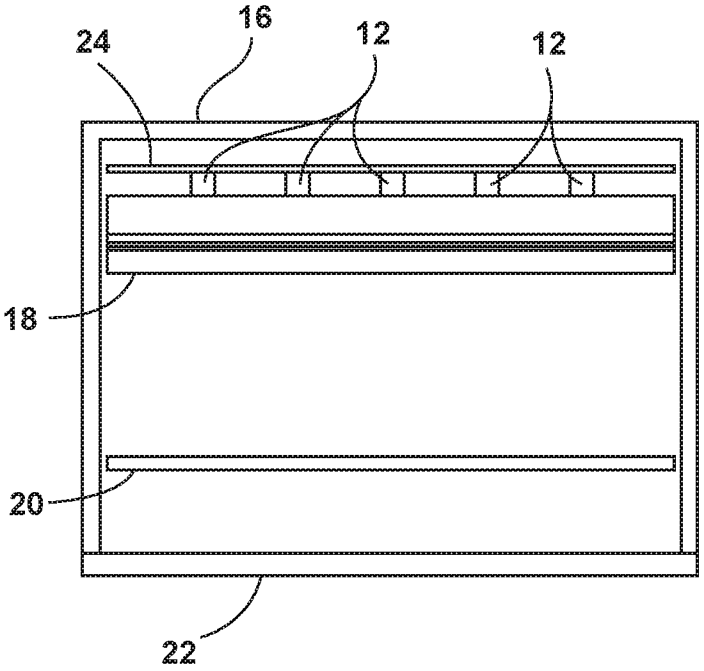
FIG. 2 includes a side view and a top view of the lighting device of FIG. 1.
Figure 2:
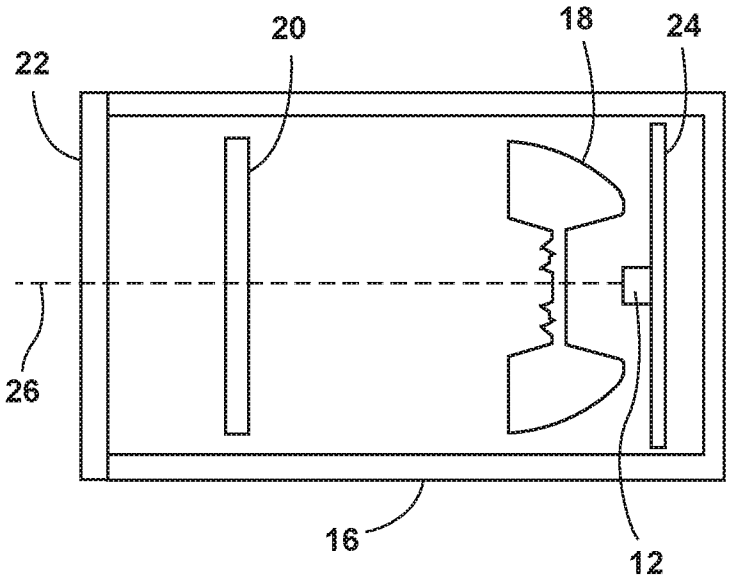
Figure 3:
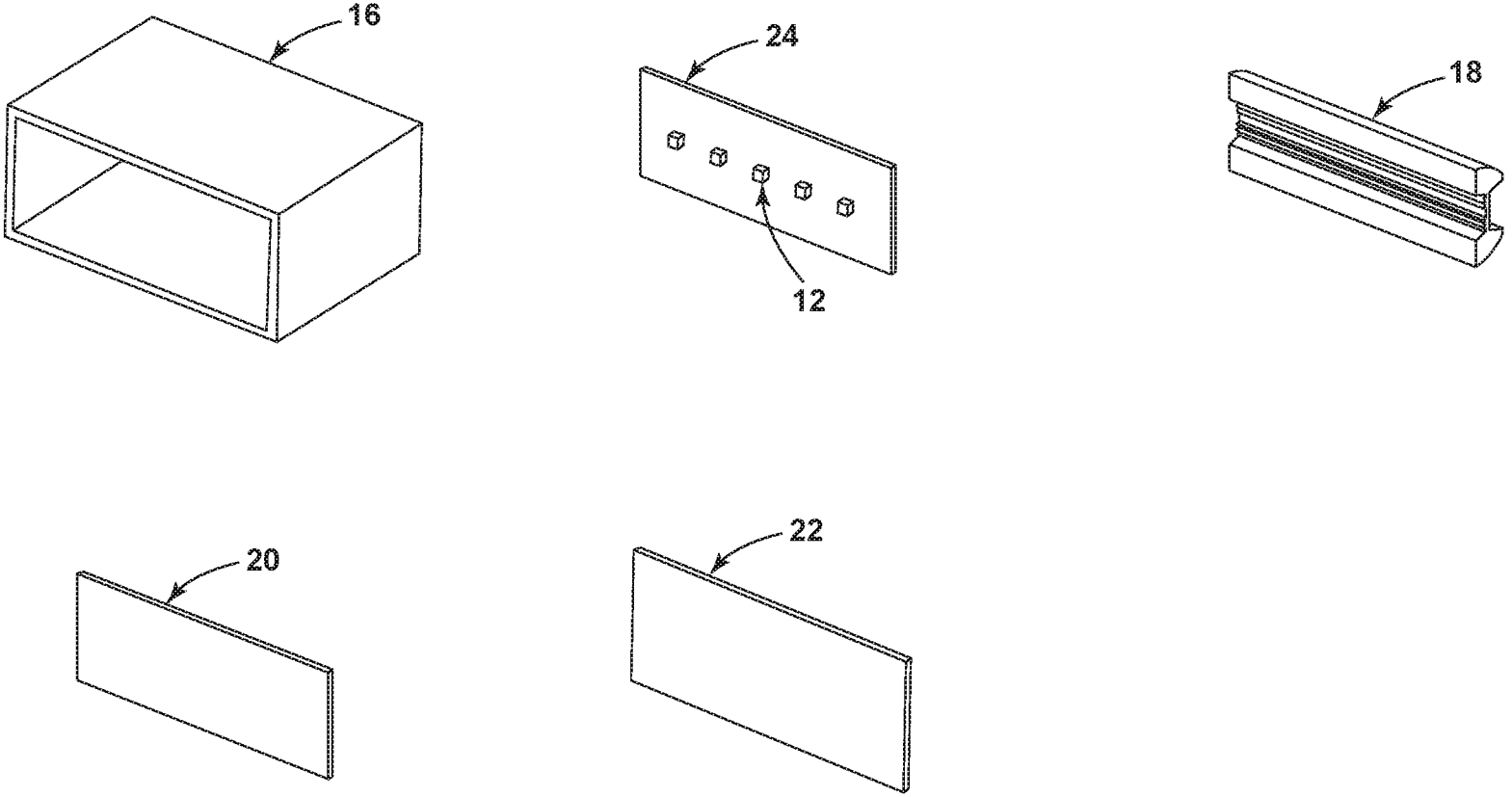
FIG. 3 includes an exploded view of the lighting device of FIG. 1.

As noted above, the lens assembly 14 includes a collimator lens 18, an inner lens 20, and an outer lens 22. As shown in FIG. 2, the collimator lens 18 is spaced apart from the array of light sources 12 along a common optical axis 26 with the inner lens 20 and the outer lens 22. The inner lens 20 is interposed between the collimator lens 18 and the outer lens 22, being spaced apart from each other such that an air gap exists therebetween, with each lens being kept in position by the sidewalls of the housing 16. Each such component of the lens assembly 14, namely the collimator lens 18, the inner lens 20, and the outer lens 22, is separately depicted in FIG. 3, along with the housing 16 and the plurality of LEDs 12.

Figure 4:
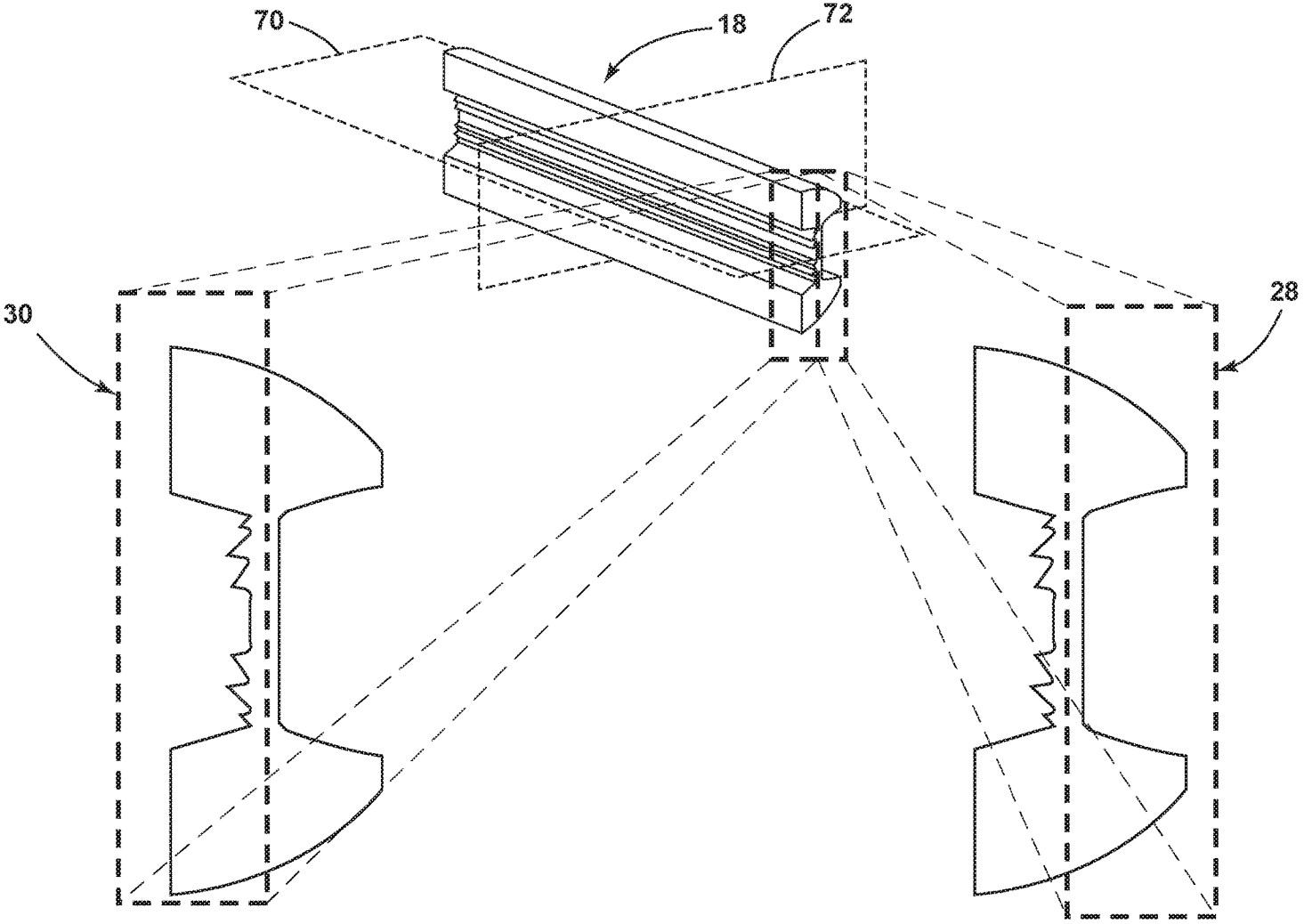
FIG. 4 includes side views of a collimator lens illustrating an incoupling section and an outcoupling section.
Figure 5:
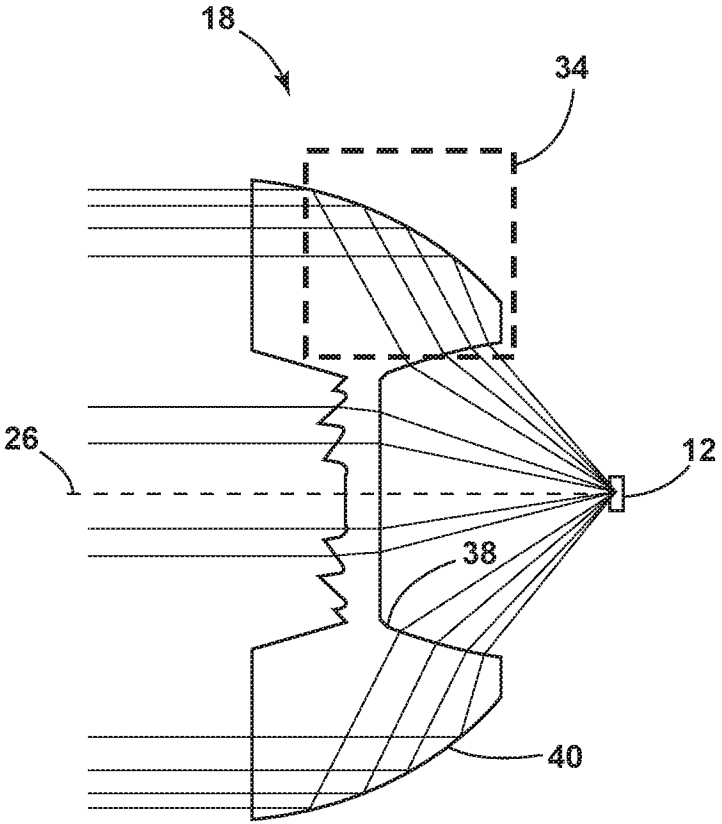
FIG. 5 includes side views of a collimator lens illustrating a central geometry and a lateral geometry of the incoupling section.
Figure 5:
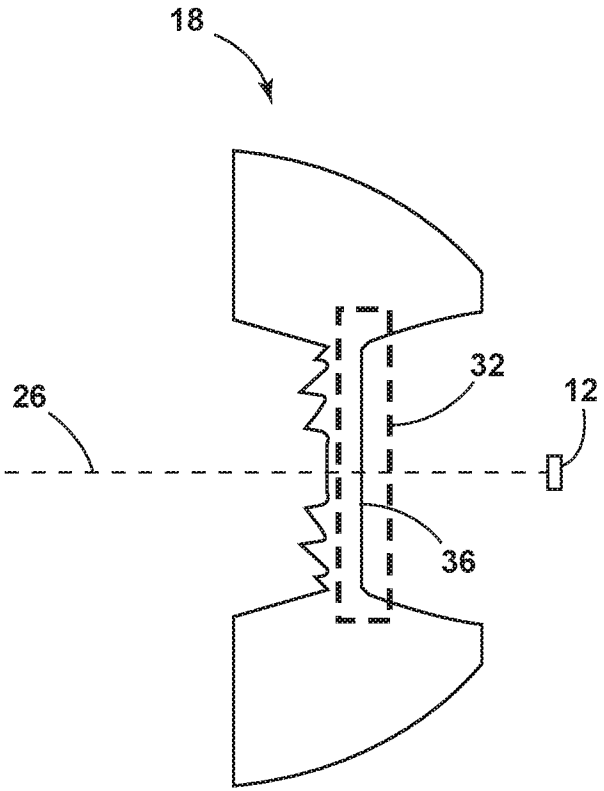

More specifically, the plurality of LEDs 12 radiate light according to a Lambertian light distribution, such that the intensity of LED light varies in proportion to the cosine of the angle between the normal direction and the direction of incident light. The collimator lens 18 is positioned relative to the PCB 24 such that it collimates the Lambertian light distribution from the plurality of LEDs 12. Referring to FIG. 4, the collimator lens 18 is formed from an optical grade, light-transmissive material and includes an incoupling section 28 that is proximal to the plurality of LEDs 12 and an outcoupling section 30 that is distal to the plurality of LEDs 12. The incoupling section 28 is further divided into a central geometry 32 and a lateral geometry 34 as shown in FIG. 5. The central geometry 32 includes a planar surface 36 in the illustrated embodiment, being normal to the optical axis 26 of the lighting device 10 along the entirety of the length of the collimator lens 18. The lateral geometry 34 includes sloped inner side surfaces 38 and curved outer side surfaces 40. Light from the plurality of LEDs 12 first impinges the sloped inner side surfaces 38, refracting outwardly, and impinges the curved outer side surfaces 40, thus collimating the light as a total internal reflection (TIR) surface as shown in FIG. 5. The curved outer side surface 40 is a section of a parabola in the current embodiment, but can form other sections of a conic or free form surfaces in other embodiments.

Figure 6:
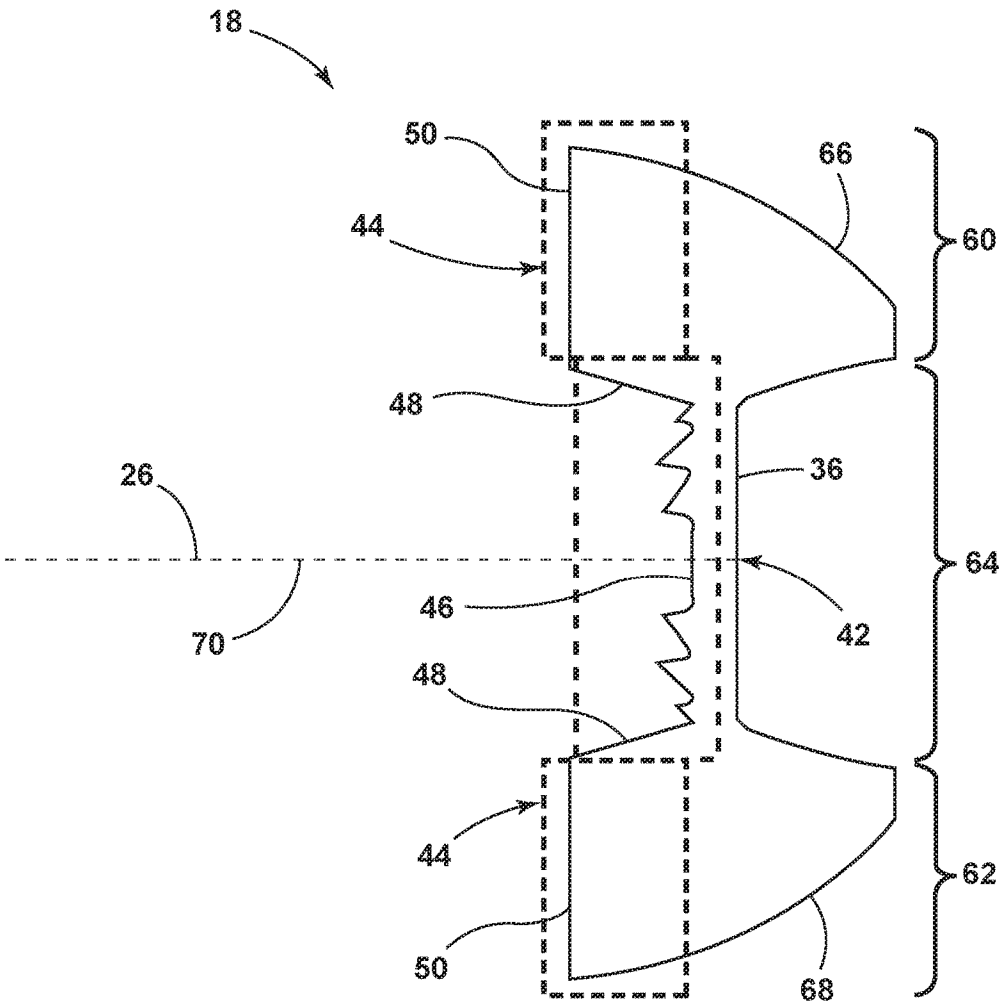
FIG. 6 includes side views of a collimator lens illustrating a central optical zone and a lateral optical zone of the outcoupling section.

The outcoupling section 30 of the collimator lens 18 is further depicted in FIG. 6. The outcoupling section 30 includes a central optical zone 42 and a lateral optical zone 44. The central optical zone 42 of the outcoupling section 30 is opposite of the central geometry 32 of the incoupling section 28. In addition, the central optical zone 42 of the outcoupling section 30 includes a textured surface 46 that is shaped as a Fresnel lens when in cross-section and that terminates at opposing side surfaces 48. The central optical zone 42 can also incorporate optical elements that can be, but are not restricted to, prismatic, cylindrical, patterns, textures, micro-optics, printed structures, and coatings. The lateral optical zone 44 of the outcoupling section 30 is a continuation of the lateral geometry 34 of the incoupling section 28. In addition, the lateral optical zone 44 of the outcoupling section 30 includes planar surfaces 50 that extend along the length of the collimator lens 18. LED light propagates through the planar surfaces 50 of the lateral optical zone 44 and through the textured surface 46 of central optical zone 42 in a generally uniform manner as collimated LED light, thereby increasing the intensity of LED light at the periphery of the optical device 10, e.g., furthest from the optical axis 26.

Collectively, the incoupling section 28 and the outcoupling section 30 cooperate to define a collimator lens 18 having an upper lens section 60, a lower lens section 62, and a central lens section 64, each being shown in FIG. 6. The upper lens section 60 is integrally formed with the central lens section 64 and emits incident light from the plurality of LEDs 12 by internally reflecting the incident light at an upper reflection surface 66, the upper reflection surface 66 optionally being parabola or other conic. The lower lens section 62 is integrally formed with the central lens section 64 and emits incident light from the plurality of LEDs 12 by internally reflecting the incident light at a lower reflection surface 68, the lower reflection surface 68 optionally being parabola or other conic. The central lens section 64 includes a planar light receiving surface 36 and a light emitting surface 46 that defines a Fresnel lens centered about the optical axis 26. The light emitting surface 46 is a discontinuous surface formation including a concentric series of prisms, with six such concentric prisms being shown in FIG. 4. As also shown in FIG. 4, the collimator lens 18 in this embodiment is symmetrical about a horizontal plane of symmetry 70 that is perpendicular to the planar light receiving surface 36 of the central lens section 64 and that is coincident with the optical axis 26. Light emitted by the plurality of LEDs 12 emerges through the collimator lens 18 as collimated light and is projected through the inner lens 20 and the outer lens 22. The collimator lens 18 is further optionally symmetrical about a vertical plane of symmetry 72 that is orthogonal to the horizontal plane of symmetry 70.

Figure 7:
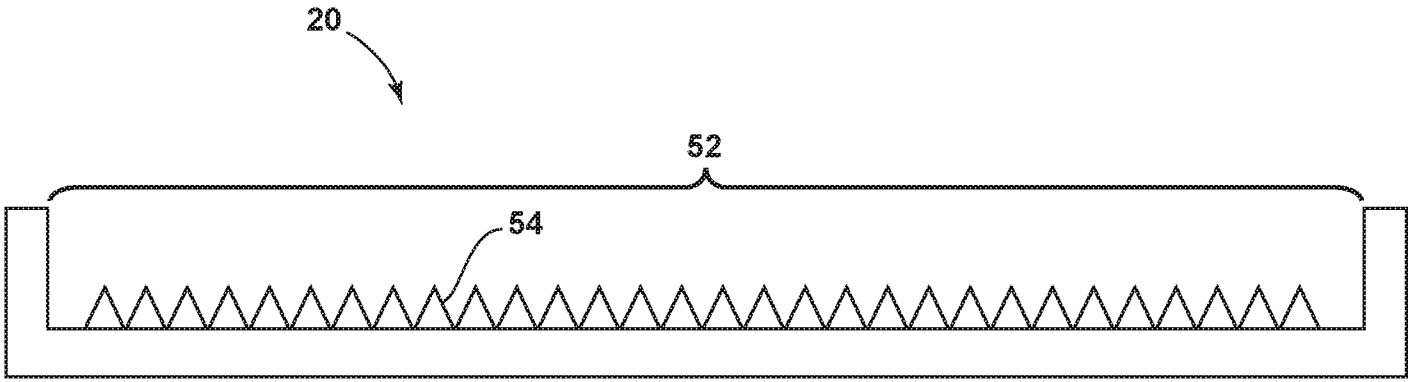
FIG. 7 includes a cross-sectional view of an inner lens.
Figure 8:
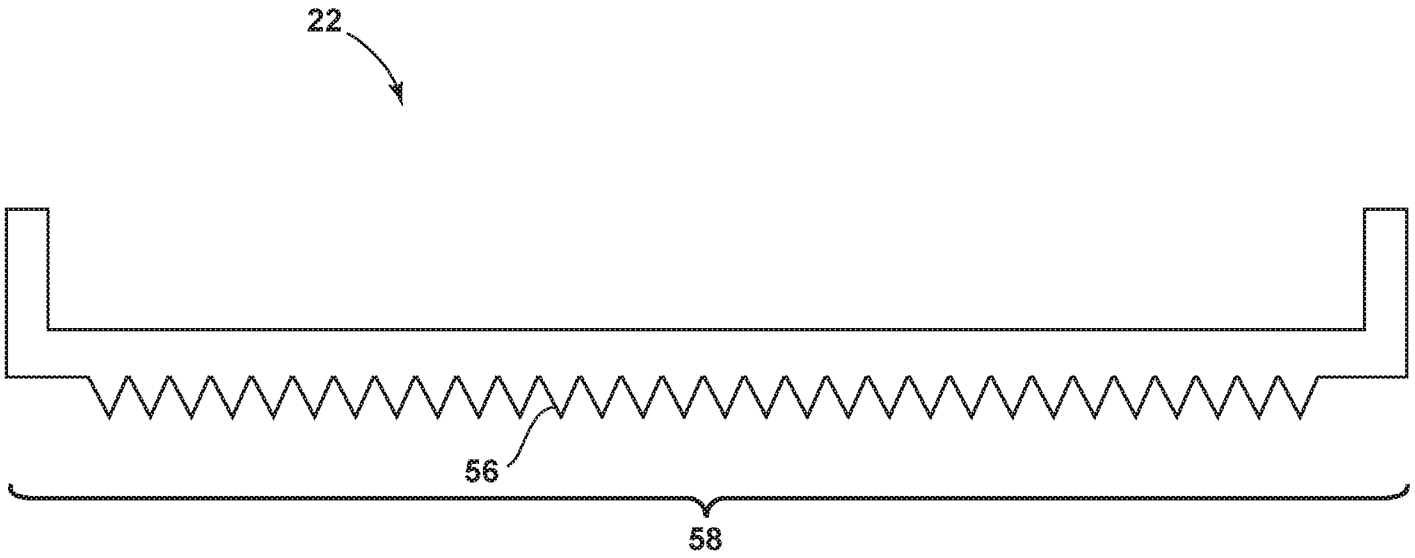
FIG. 8 includes a cross-sectional view of an outer lens.

As noted above in connection with FIG. 2, the inner lens 20 is coextensive with the collimator lens 18, being spaced apart from each other such that an air gap exists therebetween. The inner lens 20 is optically coupled to the collimator lens 18, being held in fixed relation to each other by the housing 16. Referring now to FIG. 7, the inner lens 20 includes an interior section 52. The interior section 52 of the inner lens 20 includes reflex pins 54 to reflect or redirect light from an approaching light source. The reflex pins 54 include, but are not limited to, pins having hexagonal and rectangular shapes. The outer lens 22 is similarly depicted in FIG. 8 as including reflex pins 56 along its exterior section 58. This exterior section 58 includes a shape and a curvature that is appropriate for the desired appearance of the lighting device 10, such as round, square, rectangular, or hexagonal shapes. An irregular-shaped exterior surface 58 or free-form exterior surface 58 are also possible. The outer lens 22 is positioned over an opening in the housing 16 and is a color filter in some embodiments.

These and other embodiments of the invention provide a low-cost, highly efficient lighting device 10 for generating a homogeneous lit appearance with reasonable depth and low cost for exterior lighting applications and interior lighting applications, such as ambient lighting. The collimator lens 18 and the inner lens 20 distribute light uniformly across a wide area, and the outer lens 20 functions as an enclosure while also providing a color filter. The collimator lens 18 can be manufactured with optical grade materials according to low cost extrusion techniques, without requiring expensive scattering films or greater depth for further Fresnel elements.

The above description is that of current embodiment of the invention. Various alterations and changes can be made without departing from the spirit and broader aspects of the invention. This disclosure is presented for illustrative purposes and should not be interpreted as an exhaustive description of all embodiments of the invention or to limit the scope of the claims to the specific elements illustrated or described in connection with these embodiments. Any reference to elements in the singular, for example, using the articles "a," "an," "the," or "said," is not to be construed as limiting the element to the singular.

The invention claimed is:

1. An LED lighting device for a vehicle, the LED lighting device comprising:

an outer lens;

a plurality of LED light sources;

a collimator lens disposed between the outer lens and the plurality of LED light sources, the collimator lens being formed of a light transmissive material and including an upper lens section, a lower lens section, and a central lens section; and an inner lens disposed between the collimator lens and the outer lens, wherein the inner lens includes a textured light receiving surface comprising a plurality of reflex pins, wherein the upper lens section is integrally formed with the central lens section and is configured to emit incident light from the plurality of LED light sources by internally reflecting the incident light at an upper reflection surface;

wherein the lower lens section is integrally formed with the central lens section and is configured to emit incident light from the plurality of LED light sources by internally reflecting the incident light at a lower reflection surface;

wherein the central lens section includes a light emitting surface that defines a Fresnel lens for collimating the incident light from the plurality of LED light sources, the optical axis of the plurality of LED light sources extending horizontally through the central lens section, wherein the collimator lens is symmetrical about a horizontal plane of symmetry that intercepts the optical axis of the plurality of LED light sources, such that light emitted by the plurality of LED light sources emerges through the collimator lens as collimated light and is projected through the outer lens to generate a lighting function forward or rearward of the vehicle.

2. The LED lighting device of claim 1 wherein the plurality of LED light sources are disposed in spaced relation relative to each other, each of the plurality of LED light sources including a light emitting surface opposite of a light receiving surface of the central lens section.

3. The LED lighting device of claim 1 wherein the outer lens includes a textured light emitting surface comprising a plurality of reflex pins.

4. The LED lighting device of claim 1 further including a housing to maintain the outer lens, the plurality of LED light sources, and the collimator lens in fixed relation.

5. An exterior lighting device for a vehicle, the lighting device comprising:

an array of light sources for providing a light output;

a lens assembly including a collimator lens, an inner lens, and an outer lens, wherein the collimator lens includes an incoupling section with upper and lower outward sloping side sections that function as total internal reflection surfaces and wherein the collimator lens includes an outcoupling section including a Fresnel lens for collimating the light output of the array of light sources, the inner lens and the outer lens being coextensive in length with the collimator lens; and a housing to maintain the lens assembly in fixed relation relative to the array of light sources such that a light output from the array of light sources exits the lens assembly with a homogeneous light distribution, wherein the outer lens extends over an opening in the housing, and wherein the inner lens includes a textured light receiving surface comprising a plurality of reflex pins.

6. The exterior lighting device of claim 5 wherein the collimator lens is symmetrical about a horizontal plane of symmetry extending perpendicular to a planar light receiving surface of the collimator lens.

7. The exterior lighting device of claim 6 wherein the collimator lens is symmetrical about a vertical plane of symmetry that is orthogonal to the horizontal plane of symmetry.

8. The exterior lighting device of claim 6 wherein the array of light sources includes a plurality of LEDs, and wherein the plane of symmetry coincides with each of the plurality of LEDs.

9. An exterior lighting device comprising:

an array of light sources for providing a light output;

a lens assembly including a collimator lens, an inner lens, and an outer lens, wherein the collimator lens includes an incoupling section with upper and lower outward sloping side sections that function as total internal reflection surfaces and wherein the collimator lens includes an outcoupling section including a Fresnel lens for collimating the light output of the array of light sources, the inner lens and the outer lens being coextensive in length with the collimator lens; and a housing to maintain the lens assembly in fixed relation relative to the array of light sources such that a light output from the array of light sources exits the lens assembly with a homogeneous light distribution, wherein the outer lens extends over an opening in the housing, and wherein the outer lens includes a textured light emitting surface comprising a plurality of reflex pins.

10. The exterior lighting device of claim 5 wherein the collimator lens includes an upper lens section, a lower lens section, and a central lens section, the outward sloping side sections being defined within the upper lens section and the lower lens section.

11. A method to achieve a homogeneous lit appearance for a vehicle comprising:

providing an array of light sources;

providing a lens assembly including:

a collimator lens, an inner lens, and an outer lens; and causing light to be emitted from the array of light sources such that the emitted light enters a light incoupling section of the collimator lens and escapes from a light outcoupling section of the collimator lens as collimated light, the incoupling section including outward sloping side sections that function as a total internal reflection surface, the outcoupling section including a Fresnel lens, wherein the collimated light propagates through the inner lens and the outer lens, which are held in fixed spacial relation relative to the collimator lens opposite the array of light sources to generate a lighting function forward or rearward of the vehicle, wherein the inner lens and the outer lens each include a textured surface comprising a plurality of reflex pins.

12. The method of claim 11 wherein the array of light sources includes a plurality of LED light sources that are disposed in spaced relation relative to each other.

13. The method of claim 12 wherein the collimator lens is symmetrical about a horizontal plane of symmetry extending perpendicular to a planar light receiving surface of the collimator lens.

14. The method of claim 13 wherein the collimator lens is symmetrical about a vertical plane of symmetry that is orthogonal to the horizontal plane of symmetry.

15. The method of claim 11 further including integrating the lens assembly into a head lamp of the vehicle.

16. The method of claim 11 further including integrating the lens assembly into a tail lamp of the vehicle.

* * * * *